United States Patent [19]

Gauchet

[11] 4,244,599

[45] Jan. 13, 1981

[54] MOBILE MACHINE COMPRISING A STABILIZER

[75] Inventor: Yves M. Gauchet, Duvy, France

[73] Assignee: Poclain, Belleville, France

[21] Appl. No.: 15,243

[22] Filed: Feb. 26, 1979

[30] Foreign Application Priority Data

Feb. 28, 1978 [FR] France ..... 78 05740

[51] Int. Cl.[3] ..... B66C 23/80

[52] U.S. Cl. ..... 280/764; 254/86 H

[58] Field of Search ..... 212/145; 280/764, 763, 280/765, 766; 254/45, 86 R, 86 H, 89 R, 89 H, 93 VA

[56] References Cited

U.S. PATENT DOCUMENTS

| | | | |
|---|---|---|---|
| 3,144,138 | 8/1964 | Brown et al. | 212/145 |
| 3,298,539 | 1/1967 | Sundstrom | 212/145 UX |

FOREIGN PATENT DOCUMENTS

| | | | |
|---|---|---|---|
| 1531217 | 12/1967 | Fed. Rep. of Germany | 280/764 |
| 1465607 | 12/1966 | France | 280/764 |
| 1594609 | 9/1970 | France | 212/145 |
| 2302886 | 9/1975 | France | 280/764 |
| 27554 | 11/1960 | German Democratic Rep. | 280/764 |
| 1310170 | 3/1973 | United Kingdom | 280/764 |

*Primary Examiner*—Robert J. Spar
*Assistant Examiner*—Jerold M. Forsberg
*Attorney, Agent, or Firm*—Dennison, Meserole, Pollack & Scheiner

[57] ABSTRACT

The invention relates to a mobile machine including a frame provided with a stabilizer comprising a connecting rod articulated on the frame, a shoe articulated on the connecting rod and a member for adjusting the position of the shoe with respect to the connecting rod and frame. The invention further includes two stops for limiting the rotation of the connecting rod with respect to the frame.

2 Claims, 4 Drawing Figures

MOBILE MACHINE COMPRISING A STABILIZER

Figure 1:
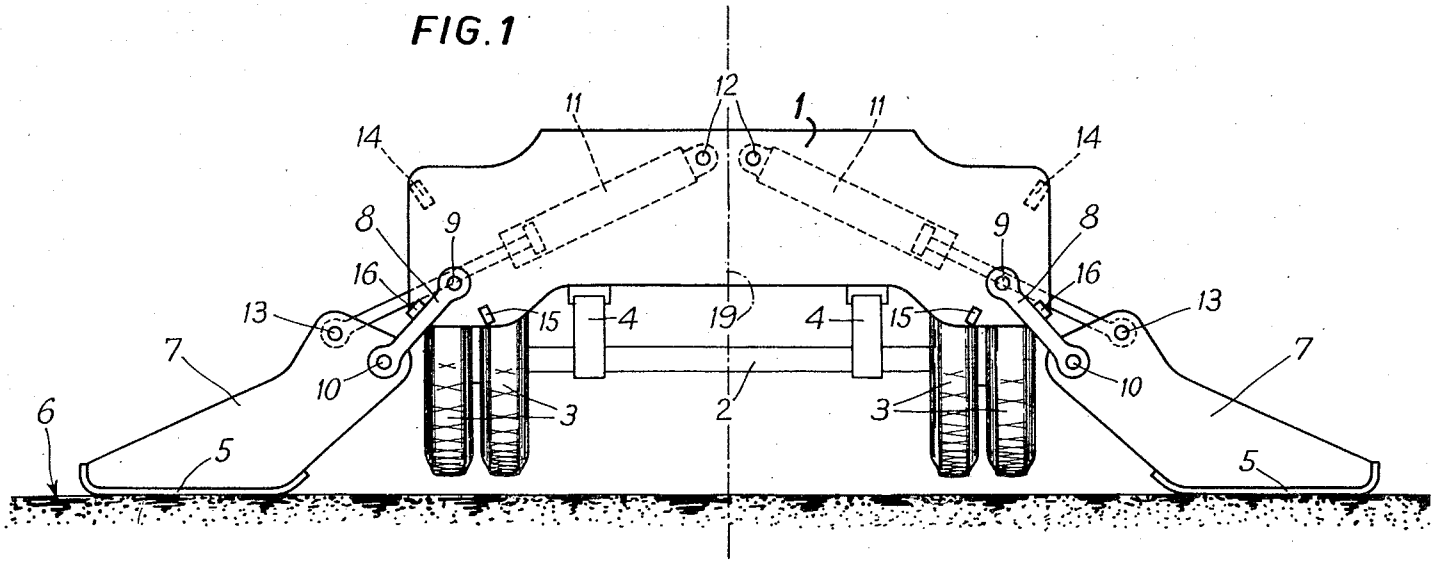

The present invention relates to a mobile machine incorporating a stabilizing device.

Numerous public works machines, such as cranes or hydraulic shovels, which are self-propelled or simply mobile, are stabilized while their working attachment is functioning. This temporary increase in stability avoids the machine overturning under the effect of the load lifted or of the effort developed.

The principle of the increase in the stability consists in increasing the dimensions of the support base by giving the machine rigid support zones, spaced as far as possible from the frame of the machine, these zones comprising stabilizers which are retractable when the machine is moving. Maximum spacing apart of the stabilizers in operation and satisfactory retraction during displacement are obviously two paradoxical conditions and it must be observed that, to this day, although satisfactory retraction has normally been achieved due to the laws and regulations governing the movement of vehicles on the highway, the efficiency of the stabilizers in operation has not always been found to be satisfactory.

This is particularly the case in devices in which the stabilizers are mounted to pivot on a support. The solution often proposed consists of combining the functional advantages of the pivoting stabilizers and of the telescopic structures. From the standpoint of the structures, the drawback of such a solution is that it is necessary to adopt telescopic arms at places having no protection, and thus expose the relatively fragile and expensive elements.

It is an object of the invention to adopt the technique of articulated elements, while conserving the advantages of the earlier solutions, by proposing a particular mode of coupling the stabilizer to the frame.

The invention therefore relates to a mobile machine comprising a frame provided with a stabilizer operable with respect to the support surface receiving said machine. The stabilizer comprises a connecting rod articulated on the frame, a shoe abutting the support surface and articulated on the connecting rod, a stop limiting the rotation of the connecting rod with respect to the frame to position the end of this connecting rod on which is articulated the shoe closer to the median plane of the frame, and a member coupled between the frame and the shoe for adjusting the position of the shoe with respect to the frame and moving said shoe between a retracted position inside the frame and an extended position outside this frame.

This machine comprises a second stop for limiting outward rotation of the connecting rod with respect to the frame, to a position wherein the end of the connecting rod on which is articulated the shoe is spaced outward from the median plane of the frame, so that the positioning of the shoe from its retracted position to its completely extended position comprises at least the following two phases:

one phase consisting in a rotation of the shoe with respect to the connecting rod with said connecting rod remaining substantially immobile near the first stop and a partial extension of the shoe outside the frame being effected, and, another phase consisting in a rotation of the connecting rod with respect to the frame, displacing this connecting rod from near the first limiting stop towards the second limiting stop, during which another partial extension of the shoe to outside the frame is effected.

The machine advantageously comprises a third stop mounted on the frame and limiting inward rotation of the shoe with respect to the connecting rod, opposite the above rotation for partial extension.

Figure 2:
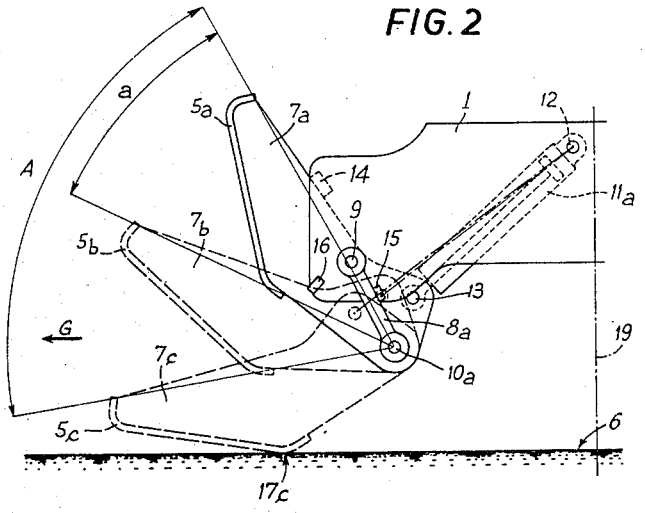
Figure 3:
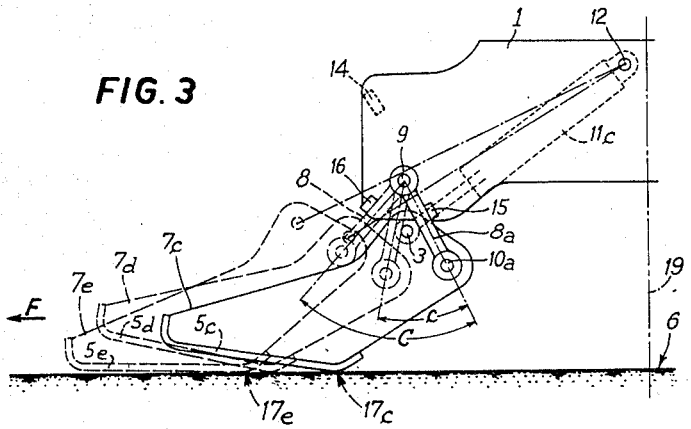
Figure 4:
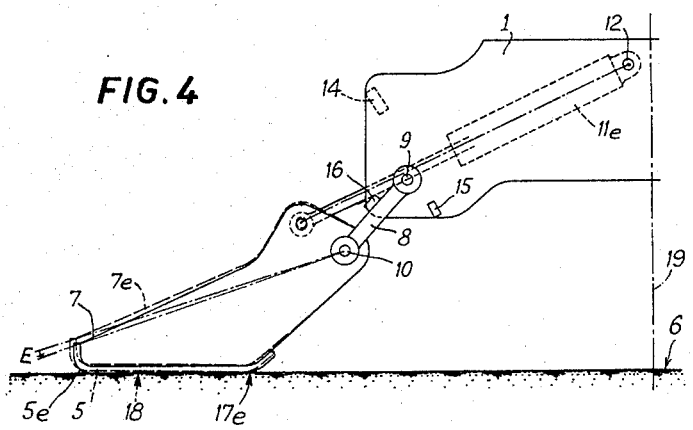

The invention will be more readily understood on reading the following description with reference to the accompanying drawings, in which:

FIG. 1 is a transverse section through a public works machine according to the invention, and FIGS. 2 to 4 are sections through a stabilizer of the machine of FIG. 1, in three distinct phases of its positioning.

Referring now to the drawings, FIG. 1 shows the frame 1 of a hydraulic shovel provided with an axle 2 with twin wheels 3. The axle 2 is conventionally connected to the frame by arms 4. A stabilizer is, furthermore, disposed on each side of the frame 1. Each stabilizer comprises a shoe assembly including a shoe 5 and an arm 7 on which the shoe 5 is welded, the shoe 5 being illustrated in firm abutment with the ground. A connecting rod 8 is articulated on the frame 1 about pin 9, while the arm 7 is itself articulated on the end of the connecting rod opposite pin 9, about a pin 10. A jack 11 is coupled between the frame 1 and the arm 7 by means of two pins 12 and 13 respectively. Three stops 14, 15 and 16 are fixed with respect to the frame 1 and adapted, as illustrated in FIGS. 2 to 4, to limit the movements of the arm 7, as far as the stop 14 is concerned, and the movement of the connecting rod 8, as far as stops 15 and 16 are concerned. It will also be noted that the abutment of the shoes 5 of the two stabilizers on the ground 6 has the effect of lifting the frame 1 to a position in which the wheels are no longer in contact with the ground. In this particular position, each connecting rod 8 is in abutment with the stop 16, each shoe 5 being parallel to the surface of the ground.

FIGS. 2 to 4 show the succession of the positions of one of the stabilizers of the machine which has been described hereinabove, between a position of retraction of the shoe and arm of the stabilizer inside the frame to the position of complete extension of FIG. 1. The elements already defined are designated by the same reference numeral as that of FIG. 1, followed by an index: a, b, c, d, e depending on the corresponding position for those of these elements whose position has varied with respect to that of FIG. 1.

In FIG. 2, the connecting rod, disposed at 8*a*, is in abutment on stop 15. The arm of the stabilizer, initially 7*a* in abutment on the stop 14, pivots about the pin 10*a* of the connecting rod 8*a* and takes with it the shoe. This arm therefore occupies the successive positions 7*a*, 7*b*, 7*c*, and, in its pivoting, has taken the shoe from its position 5*a* to an intermediate position 5*b*, then to a third position 5*c* and has provoked a displacement of this shoe to outside the frame 1 (G). In this position 5*c*, an angular edge 17*c* of the shoe has come into contact with the ground 6. The movement has effected under the combined effects of the controlled extension of the jack 11*a* and of the actual weight of the stabilizer arm 7*a* and shoe 5*a*, with the stabilizer first pivoting by angle a about the pivoting pin 10*a*, which is immobile like the connecting rod 8*a* which supports it. In the position 7*c*, the pivoting of the arm 7*c* about pin 10*a*, having reached an angle A, is provisionally stopped by the reaction of the ground on the edge 17*c*. The second phase of positioning of the stabilizer then begins, as shown in FIG. 3.

FIG. 3 shows three positions of the stabilizer located by the position of its arm. The continuing extension of jack 11*c* and the abutment of the edge 17*c* on the ground 6 provoke combined pivotings of the connecting rod 8*a*, by angle c, about the axis 9, and of the arm 7*c* about axis 10*a*. The arm, starting from position 7*c*, passing through an intermediate position 7*d*, arrives in the final position 7*e* of this phase. The shoe of the stabilizer has, itself, taken the successive positions 5*c*, 5*d*, 5*e*. This shoe arrives at 5*e* when the connecting rod stops its pivoting, by angle C, at 8, abutting on the stop 16, and is then in abutment on the ground 6 by its edge 17*e*.

It then remains for the jack 11*e*, during the last phase of positioning, to terminate its extension to pivot the arm 7*e* by an angle E about the pin 10 supported by the connecting rod 8, and cause the contact of the shoe with the ground 6 to be made no longer only via the edge 17*e*, but to be made via the whole support surface 18 of this shoe, in its final position 5 (FIG. 4).

The retraction of the jack naturally effects a sequence of positions for the stabilizer opposite the sequence effected during the extension of the jack, which has just been set forth.

The influence of the pivoting of the connecting rod about pin 9 (angle C) on the positioning of the stabilizer will be noted. In the conventional prior known arrangement, the arm 7*a* is mounted to pivot on the frame 1. A similar arrangement would be that in which the connecting rod 8*a* is immobile with respect to the frame 1, the arm 7*a* pivoting about the axis 10*a* being able, at the most, to reach position 7*c*, and the shoe position 5*c* before said shoe rests on the ground 6. According to the new arrangement, the connecting rod 8*a* may further pivot from 8*a* to 8, this enabling the shoe to move from 5*c* to 5*e* to outside (arrow F of FIG. 3) the frame with respect to the central axis of symmetry 19 of said frame. The significance of the invention and the progress that it brings lies in this complementary displacement, all else remaining equal. In particular, the position 5*a* of retraction of the shoe along the frame is identical to that of a shoe fixed to an arm articulated on the frame 1.

Of course, it is readily understood that the complementary displacement of the shoe, between its positions 5*c* and 5*e*, is essentially obtained when the connecting rod 8*a*/8 moves about a substantially vertical mean position, so that the displacement of the pin 10*a*, and therefore of the stabilizer, is essentially horizontal.

What is claimed is:

1. A mobile machine comprising a frame provided with a stabilizer operable with respect to the support surface receiving said machine, said stabilizer comprising a connecting rod with opposed first and second ends articulated at a first end on the frame, a shoe assembly for abutment on the support surface, said shoe assembly being articulated on the second end of the connecting rod, a stop on the frame limiting inward rotation of the connecting rod about the first end relative to the frame whereby the second end of the connecting rod on which the shoe assembly is articulated is positioned inwardly toward the median plane of the frame and an adjustable member for adjusting the position of the shoe assembly with respect to the frame coupled between the frame and the shoe assembly, said member being articulated to the frame and shoe assembly at points spaced respectively from the first and second ends of the connecting rod and adapted to place said shoe assembly between an inward retracted position relative to the frame and a position of complete extension outward relative to the frame, said stabilizer further comprising a second stop on the frame limiting outward rotation of the connecting rod with respect to the frame with the end of the connecting rod on which the shoe assembly is articulated being positioned outward relative to the median plane of the frame; whereby the positioning of the shoe assembly from its retracted position to its completely extended position comprises at least the following two phases:

one phase comprising a rotation of the shoe with respect to the connecting rod with said connecting rod remaining substantially immobile near the first stop, and a partial extension of the shoe to outside the frame being effected, and another phase comprising a rotation of the connecting rod with respect to the frame, displacing this connecting rod from near the first stop towards the second stop, during which another partial extension of the shoe to outside the frame is effected.

2. The machine of claim 1 including a third stop on the frame for limiting inward rotation of the shoe assembly with respect to the connecting rod.

* * * * *